US010488155B2

(12) United States Patent
Bernard et al.

(10) Patent No.: US 10,488,155 B2
(45) Date of Patent: Nov. 26, 2019

(54) METHOD AND APPARATUS FOR ELECTRO-MECHANICAL SUPER-ELEVATION

(71) Applicant: Raytheon Company, Waltham, MA (US)

(72) Inventors: Robert P. Bernard, McKinney, TX (US); Sean Thomas, Georgetown, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/604,390

(22) Filed: Jan. 23, 2015

(65) Prior Publication Data

US 2016/0216071 A1 Jul. 28, 2016

(51) Int. Cl.

| | |
|---|---|
| ***F41G 1/00*** | (2006.01) |
| ***F41G 1/393*** | (2006.01) |
| ***F41G 11/00*** | (2006.01) |
| ***F41G 3/06*** | (2006.01) |
| ***F41G 1/44*** | (2006.01) |
| ***F41G 1/473*** | (2006.01) |

(52) U.S. Cl.

CPC ..... *F41G 1/393* (2013.01); *F41G 1/44* (2013.01); *F41G 1/473* (2013.01); *F41G 3/06* (2013.01); *F41G 11/001* (2013.01); *F41G 11/002* (2013.01); *F41G 11/003* (2013.01)

(58) Field of Classification Search

CPC ... F41G 1/473; F41G 1/00; F41G 3/16; F41G 3/00; F41G 3/147; F41G 3/005; F41G 3/02

See application file for complete search history.

(56) References Cited

U.S. PATENT DOCUMENTS

| | | | | | |
|---|---|---|---|---|---|
| 2,388,010 | A * | 10/1945 | Pohl | F41G 5/04 | 89/36.13 |
| 2,428,870 | A * | 10/1947 | Essex | F41G 5/02 | 235/405 |
| 2,502,506 | A * | 4/1950 | Chase | F41G 5/02 | 89/204 |
| 2,577,785 | A * | 12/1951 | Lyon | F41G 3/06 | 235/405 |

(Continued)

FOREIGN PATENT DOCUMENTS

| | | | | |
|---|---|---|---|---|
| DE | 1946972 A1 * | 4/1970 | ..... | F41G 1/3935 |
| EP | 2 452 151 A0 | 5/2012 | | |
| WO | WO 2013176644 A1 * | 11/2013 | ..... | F41G 1/48 |

*Primary Examiner* — Christopher Stanford

(57) ABSTRACT

A weapon system includes a weapon, a weapon sight configured to sight a target of the weapon, and an electro-mechanical super-elevation (EMSEL) system. The EMSEL system includes a weapon adapter coupled to the weapon, an electronics mount coupled to the weapon sight, a drive assembly coupled to the weapon adapter and the electronics mount, and a controller. The controller is configured to determine that the weapon is changing in angular orientation. The controller is also configured, in response to the determination that the weapon is changing in angular orientation, to control the drive assembly to adjust an angle of the electronics mount relative to the weapon while the weapon is changing in angular orientation such that the electronics mount remains substantially at a predetermined angle relative to the target.

21 Claims, 9 Drawing Sheets

(56) References Cited

U.S. PATENT DOCUMENTS 3,685,159 A * 8/1972 Erhard ..... F41G 3/06 89/204
6,499,382 B1 * 12/2002 Lougheed ..... F41G 3/06 89/41.05
8,047,118 B1 * 11/2011 Teetzel ..... F41G 1/473 235/414
8,100,044 B1 * 1/2012 Teetzel ..... F41G 1/473 235/414
8,240,075 B1 * 8/2012 Mullin ..... F41G 1/38 42/119
8,561,518 B2 * 10/2013 Teetzel ..... F41G 1/473 235/414
9,506,723 B2 * 11/2016 Teetzel ..... F41G 1/35
2009/0139393 A1 * 6/2009 Quinn ..... F41A 27/28 89/41.18
2009/0266892 A1 * 10/2009 Windauer ..... F41G 1/38 235/404
2010/0175295 A1 * 7/2010 Hoel ..... F41G 11/003 42/90
2010/0275497 A1 * 11/2010 Brentzel ..... F41G 11/004 42/125
2011/0010981 A1 * 1/2011 Wieland ..... F41G 1/473 42/114
2012/0279107 A1 * 11/2012 Hoel ..... F41G 11/003 42/90
2013/0008073 A1 * 1/2013 Clifton ..... F41G 1/387 42/125
2014/0103112 A1 * 4/2014 Piazza ..... F41G 3/165 235/407
2014/0123536 A1 * 5/2014 Hamm ..... F41G 11/003 42/125
2015/0316351 A1 * 11/2015 Choiniere ..... F41G 3/323 42/111

* cited by examiner

METHOD AND APPARATUS FOR ELECTRO-MECHANICAL SUPER-ELEVATION

TECHNICAL FIELD

This disclosure is directed in general to weapon systems. More specifically, this disclosure relates to a method and apparatus for electro-mechanical super-elevation for a weapon.

BACKGROUND

Many low-velocity round weapons, such as automatic grenade launchers, require an operator to aim substantially higher than an intended target in order to account for the drop of a projectile over its path due to gravity. This often requires different aim points that are dependent on the target's range, where the different aim points are typically determined by use of a mechanical bracket with iron sights on the weapon. Using brackets typically limits the "first shot" aim accuracy since it requires the operator to first estimate the target's range and then adjust the weapon to the closest bracket crosshair increment.

SUMMARY

This disclosure provides a method and apparatus for electro-mechanical super-elevation for a weapon.

In a first embodiment, a method includes determining that a weapon is changing in angular orientation. The method also includes, in response to the determination that the weapon is changing in angular orientation, adjusting an angle of an electronics mount relative to the weapon while the weapon is changing in angular orientation such that the electronics mount remains substantially at a predetermined angle relative to a target. The electronics mount is coupled to the weapon, and the electronics mount supports a weapon sight that is configured to sight the target.

In a second embodiment, an apparatus includes a weapon adapter configured to couple to a weapon, an electronics mount configured to couple to a weapon sight that is configured to sight a target, a drive assembly coupled to the weapon adapter and the electronics mount, and a controller. The controller is configured to determine that the weapon is changing in angular orientation. The controller is also configured, in response to the determination that the weapon is changing in angular orientation, to control the drive assembly to adjust an angle of the electronics mount relative to the weapon while the weapon is changing in angular orientation such that the electronics mount remains substantially at a predetermined angle relative to the target.

In a third embodiment, a weapon system includes a weapon, a weapon sight configured to sight a target of the weapon, and an electro-mechanical super-elevation (EMSEL) system. The EMSEL system includes a weapon adapter coupled to the weapon, an electronics mount coupled to the weapon sight, a drive assembly coupled to the weapon adapter and the electronics mount, and a controller. The controller is configured to determine that the weapon is changing in angular orientation. The controller is also configured, in response to the determination that the weapon is changing in angular orientation, to control the drive assembly to adjust an angle of the electronics mount relative to the weapon while the weapon is changing in angular orientation such that the electronics mount remains substantially at a predetermined angle relative to the target.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1A:
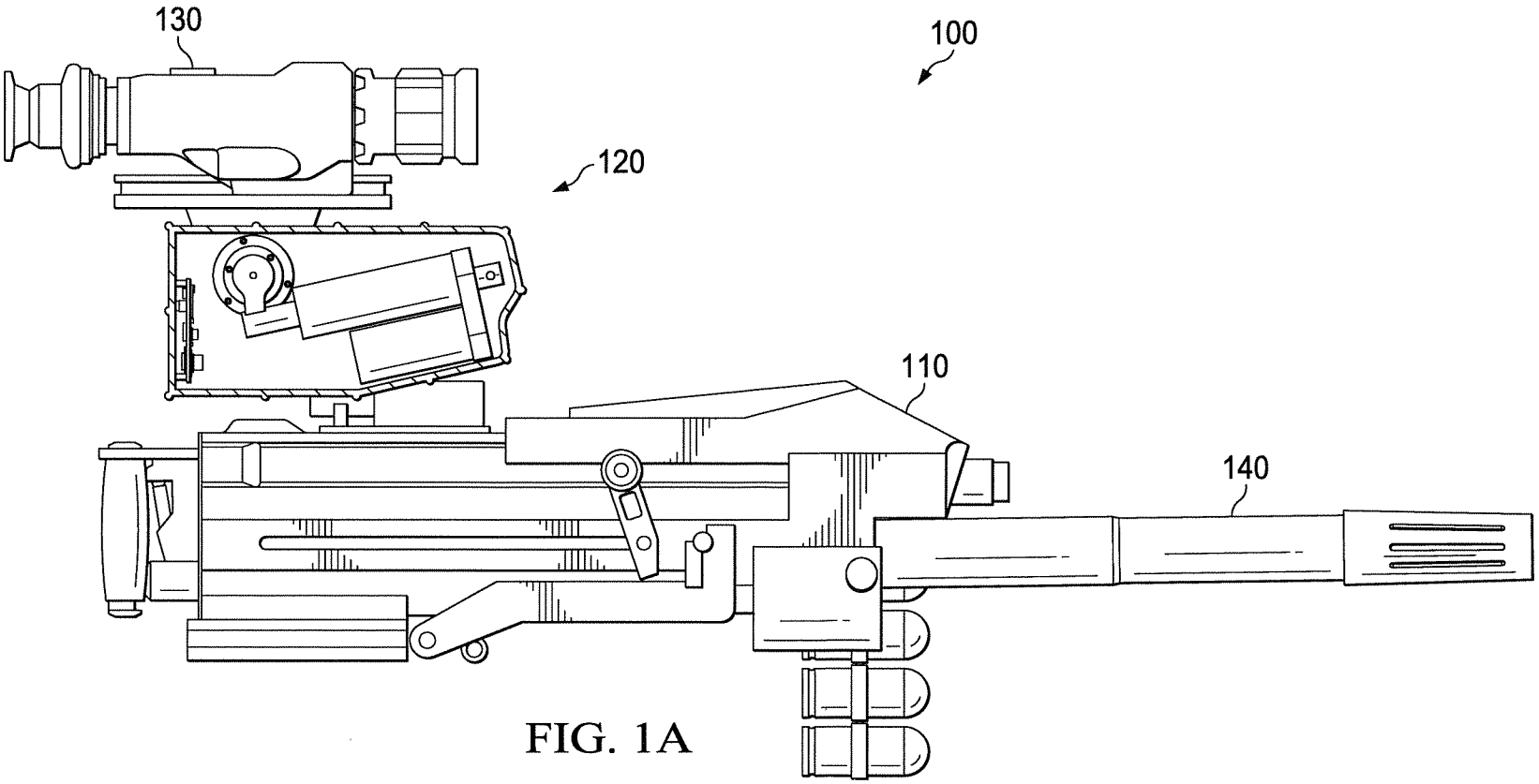
FIGS. 1A and 1B illustrate views of an example weapon system with an integrated electro-mechanical super elevation (EMSEL) system according to this disclosure.

FIGS. 1 through 6, described below, and the various embodiments used to describe the principles of the present disclosure in this patent document are by way of illustration only and should not be construed in any way to limit the scope of the disclosure. Those skilled in the art will understand that the principles of the present disclosure may be implemented in any type of suitably arranged device or system.

As noted above, various low-velocity round weapons often require an operator to aim substantially higher than an intended target in order to account for the drop in a projectile. Some fire control systems have been developed that integrate a range finder and sensor. Introducing a range finder allows a fire control system to calculate the aim point for a given target. Some systems accomplish fire control with the use of a motor-driven steering mirror unit and thermal weapon sight. An operator can aim a laser to determine a target range, and the system can adjust a reticle based on ballistics calculations. The operator then re-aims to the adjusted reticle before firing. However, such systems are often large and heavy, have high power requirements, and require long elapsed time from target identification to target fire. Many such systems also often require custom sensors or are limited to using just one sensor. In some cases, costly components (such as a clutch system) or precision optics are required. Also, because the range finder is not integrated, the operator is required to range a target and then significantly reposition the weapon to the calculated ballistic solution.

To address these or other issues, embodiments of this disclosure provide an electro-mechanical super elevation (EMSEL) system for use with a low-velocity round weapon with high visual accuracy. The EMSEL system provides an "eyes-on-target" modular ballistic solution (MBS) system using an electro-mechanical approach that does not rely on costly mirrors and windows while providing a platform for multiple imaging system technologies. The functions of this accurate ballistic solution system are provided by a compact, lightweight drive unit that can be attached to the body of a weapon with which the use of super-elevation is desired or required.

The drive unit significantly reduces the time from target identification to target engagement. The drive unit adjusts an electronics mount containing a laser range finder and one or more optical sensors. Because the sensors are moved on a single plate, fire control solutions calculated using ballistic drop data are presented to the operator and may involve very little readjustment from the laser ranging aim point to the target solution aim point. The drive unit consumes low amounts of power during operation and can be stabilized without power. Using the disclosed embodiments, the laser range finder may constantly remain in close proximity of the target so that the operator's eyes are constantly on target.

It will be understood that embodiments of this disclosure may include any one, more than one, or all of the features described here. In addition, embodiments of this disclosure may additionally or alternatively include other features not listed here.

Figure 1B:
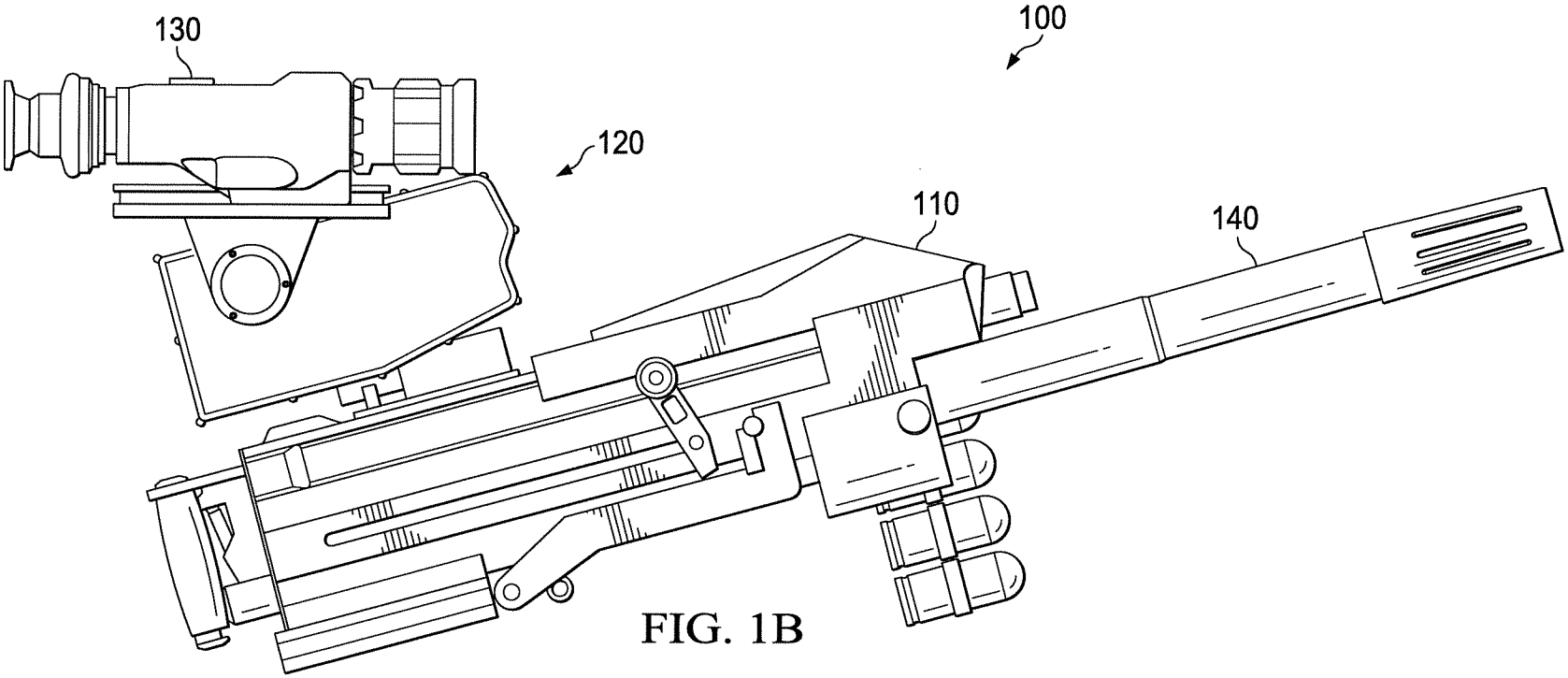

FIGS. 1A and 1B illustrate views of an example weapon system 100 with an integrated EMSEL system according to this disclosure. The embodiment of the weapon system 100 shown in FIGS. 1A and 1B is for illustration only. Other embodiments of the weapon system 100 could be used without departing from the scope of this disclosure.

As shown in FIGS. 1A and 1B, the weapon system 100 includes a weapon 110, an EMSEL system 120, and a weapon sight 130. In FIG. 1A, the weapon 110 is substantially horizontal with respect to its barrel 140. In FIG. 1B, the weapon 110 is in an elevated position for launching or firing of artillery or other rounds.

The weapon 110 can include any of a variety of low-velocity round weapons, such as an automatic grenade launcher. In particular embodiments, the weapon 110 can be an MK19 grenade launcher. The weapon 110 is variably adjustable up and down through a range of angles. Because of the low velocity of its rounds, the weapon 110 typically is placed in an elevated angle position (such as about 30° to about 40° from horizontal, dependent on target distance) to fire each round as shown in FIG. 1B.

The EMSEL system 120 provides a stable platform for the weapon sight 130. As the weapon 110 moves up or down in angle, the EMSEL system 120 automatically adjusts to maintain the weapon sight 130 in a stable, substantially static position. The EMSEL system 120 includes various components configured to adjust the weapon sight 130 relative to the weapon 110, including one or more sensors, adapter plates, drive assemblies, and electronic control circuitry. These components are described in greater detail below.

The weapon sight 130 allows a weapon operator to sight a target in order to accurately aim the weapon 110. In some embodiments, the weapon sight 130 can include one or more laser range finders (LRFs) or other sighting components to facilitate accurate and precise targeting. Ideally, the position of the weapon sight 130 is stabilized such that the eyes of the operator can constantly remain focused on a target without substantial jitter or movement up or down of the weapon sight 130. Some conventional weapon sights use complex optics, including one or more mirrors, to facilitate this objective. Such mirrors reflect light at a particular angle, which causes an overall doubling of the angle (incident angle+reflecting angle) and promotes jitter. In the weapon system 100, because the weapon sight 130 is coupled to the stabilizing EMSEL system 120, the weapon sight 130 can be comprised of simpler components while still providing a continuous "eyes-on-target" view for the operator.

Although FIGS. 1A and 1B illustrate one example of a weapon system 100, various changes may be made to FIGS. 1A and 1B. For example, the EMSEL system 120 may be configured or coupled to the weapon 110 in a different manner than shown in the figures. Also, the makeup and arrangement of the weapon system 100 is for illustration only. Components could be added, omitted, combined, or placed in any other configuration according to particular needs.

Figure 2:
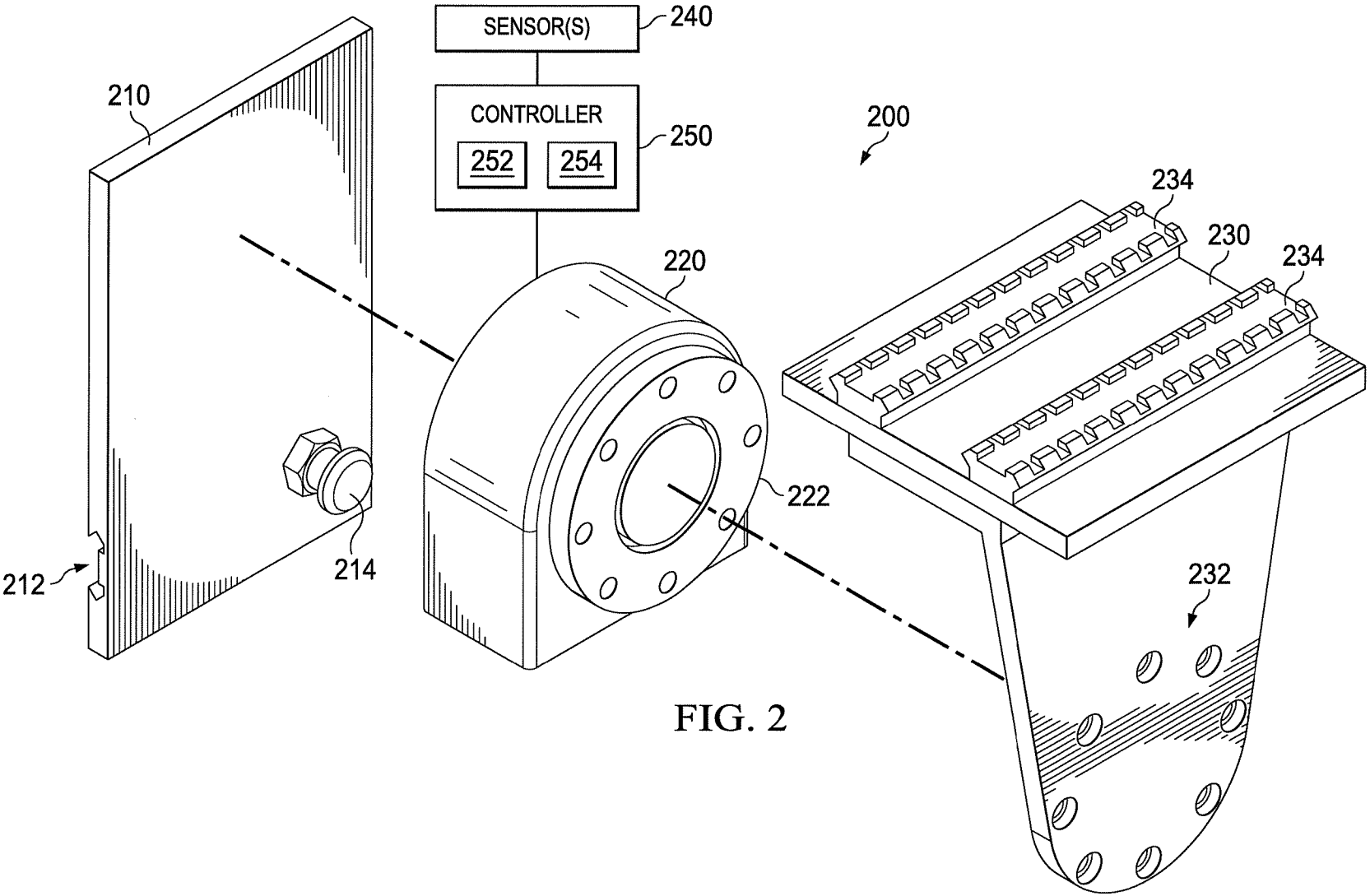
FIG. 2 illustrates example components of an EMSEL system according to this disclosure.

FIG. 2 illustrates example components of an EMSEL system 200 according to this disclosure. The EMSEL system 200 could, for example, represent the EMSEL system 120 of FIGS. 1A and 1B. The EMSEL system 200 shown in FIG. 2 is for illustration only. Other embodiments of the EMSEL system 200 could be used without departing from the scope of this disclosure.

As shown in FIG. 2, the EMSEL system 200 includes a weapon adapter 210, a drive assembly 220, an electronics mount 230, one or more sensors 240, and a controller 250. The weapon adapter 210 includes a mechanical adapter configured to couple the EMSEL system 200 to a weapon, such as the weapon 110 of FIGS. 1A and 1B. The weapon adapter 210 can provide a modular platform for attaching the EMSEL system 200 to a wide variety of different weapon systems and weapon platforms.

As shown here, the weapon adapter 210 can include a substantially flat plate that mounts vertically to a side wall of a weapon. The back side of the plate (the side facing inward toward the side wall of the weapon) can include one or more rails, dovetail connectors, or other suitable connection elements 212 that couple to corresponding rails or connection elements in the side wall of the weapon. A set screw 214 or other fastening mechanism can securely connect the weapon adapter 210 to the weapon. As long as the weapon includes a corresponding mounting location and connecting hardware, the weapon adapter 210 allows the EMSEL system 200 to be installed on and used with a projectile launching system with firing angles that are substantially different from the operator's line of sight.

The drive assembly 220 includes an electro-mechanical drive unit that moves the electronics mount 230 (and any attached weapon sight) relative to the weapon adapter 210. An outer surface of the drive assembly 220 connects to a front surface of the flat plate of the weapon adapter 210 as indicated by the dashed lines in FIG. 2. A rotation element 222 of the drive assembly 220 is configured to rotate relative to the remainder of the drive assembly 220. The rotation element 222 is, in turn, configured for connection to the electronics mount 230. Any suitable mechanisms can be used to connect the drive assembly 220 to the weapon adapter 210 and to connect the rotation element 222 to the electronics mount 230. In some embodiments, the rotation element 222 includes a circuit bolt pattern to connect the electronics mount 230 to the drive assembly 220 via a plurality of bolts as indicated by the dashed lines in FIG. 2. In some embodiments, the rotation element 222 is disposed on a front surface of the drive assembly 220. This makes the rotation element 222 easily accessible for installation or maintenance of one or more electronics mounts 230. Of course, a plurality of bolts in a circular bolt pattern is merely one example for connecting the drive assembly 220 to the electronics mount 230. Other connection mechanisms may also be used.

The drive assembly 220 includes a drive mechanism used to drive the electronics mount 230 to a specified ballistic position. Operation of the drive mechanism causes the rotation element 222 to rotate relative to the drive assembly 220. This causes the electronics mount 230 to change angle relative to the weapon adapter 210 and the weapon. In some embodiments, the drive mechanism can be a torque motor or linear actuator, both of which are described in greater detail below.

The electronics mount 230 is configured for mounting a weapon sight, such as the weapon sight 130 of FIGS. 1A and 1B, to the drive assembly 220. The electronics mount 230 includes a flat plate with one or more connection elements, such as a circular bolt pattern 232, configured to connect the electronics mount 230 to the drive assembly 220. The electronics mount 230 can have a modular design configured to accept many weapon different sight technologies, including existing and future sight technologies. The weapon sight may include one or more optical sensors, optical lenses, range finders, or any other suitable components. This allows the integration of various weapon sights, including thermal weapon sight (TWS) modular ballistic solution (MBS) fire control, with various weapons. In particular embodiments, the electronics mount 230 includes standard Mil-1913 rail mounts 234 that are configured for attaching many common day view optics, thermal optics, and laser range finders. In some embodiments, the rail mounts 234 are configured for attaching a flat panel display to the electronics mount 230 for a large, stabilized view of targets.

The EMSEL system 200 includes one or more sensors 240. The sensors 240 could include one or more position or angle sensors (such as at least one accelerometer or inertial measurement unit) to measure the position, orientation, or angle of the electronics mount 230, the weapon adapter 210, the rotation element 222, or any other component relative to horizontal, relative to the weapon, or relative to each other. Measurements from the sensors 240 can be transmitted to the controller 250 for use in determining the position and angle of the weapon sight or the weapon. In particular embodiments, the sensors 240 may include an encoder or resolver as described in greater detail below.

The controller 250 is configured to control the overall operation of the EMSEL system 200, including operation of the drive assembly 220 to move the electronics mount 230 (and attached weapon sight) relative to the weapon adapter 210 (and attached weapon). In one aspect of operation, the controller 250 receives angle or position measurement values from the sensor(s) 240, determines a current angular position of the electronics mount 230 and weapon adapter 210 (and the attached weapon sight and weapon), determines a necessary position adjustment of the electronics mount 230, and sends one or more control signals to the drive assembly 220 to cause the drive assembly 220 to adjust the angular position of the electronics mount 230.

The controller 250 includes any suitable structure for receiving one or more sensor measurements and controlling one or more electro-mechanical devices. For example, the controller 250 could include one or more processing devices 252, such as one or more microprocessors, microcontrollers, digital signal processors, field programmable gate arrays, or application specific integrated circuits. The controller 250 also includes one or more memories 254, such as one or more volatile and/or non-volatile storage devices, configured to store instructions and data used, generated, or collected by the processing device(s) 252.

Overall, the EMSEL system 200 provides the ability to range a target while a weapon is super-elevated. The response time of the EMSEL 200 allows for fast engagement of a target, such as within approximately one second after range finding. The EMSEL 200 is also highly accurate and stable, such as by providing a <1 MOA (minute of angle) line of sight (LOS) stability and an approximately 2 MOA pointing accuracy.

Figure 3A:
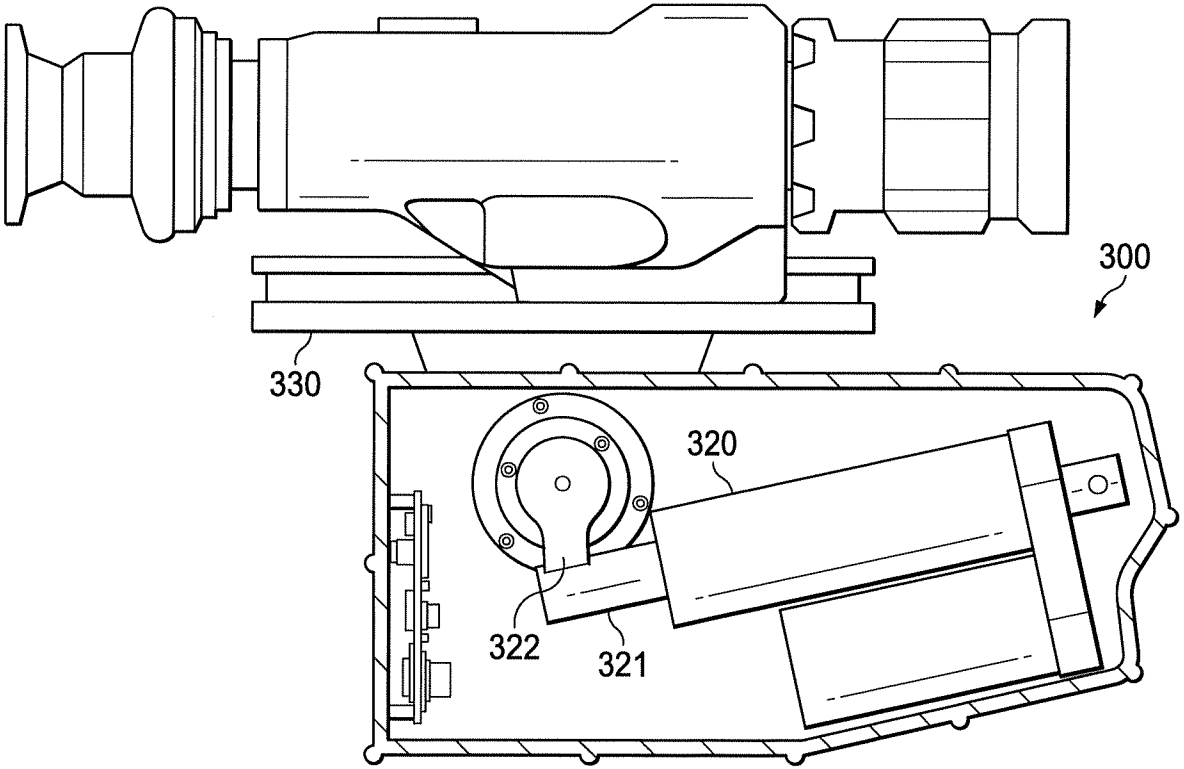
FIGS. 3A and 3B illustrate an example EMSEL system that includes a linear actuator according to this disclosure.
Figure 3B:
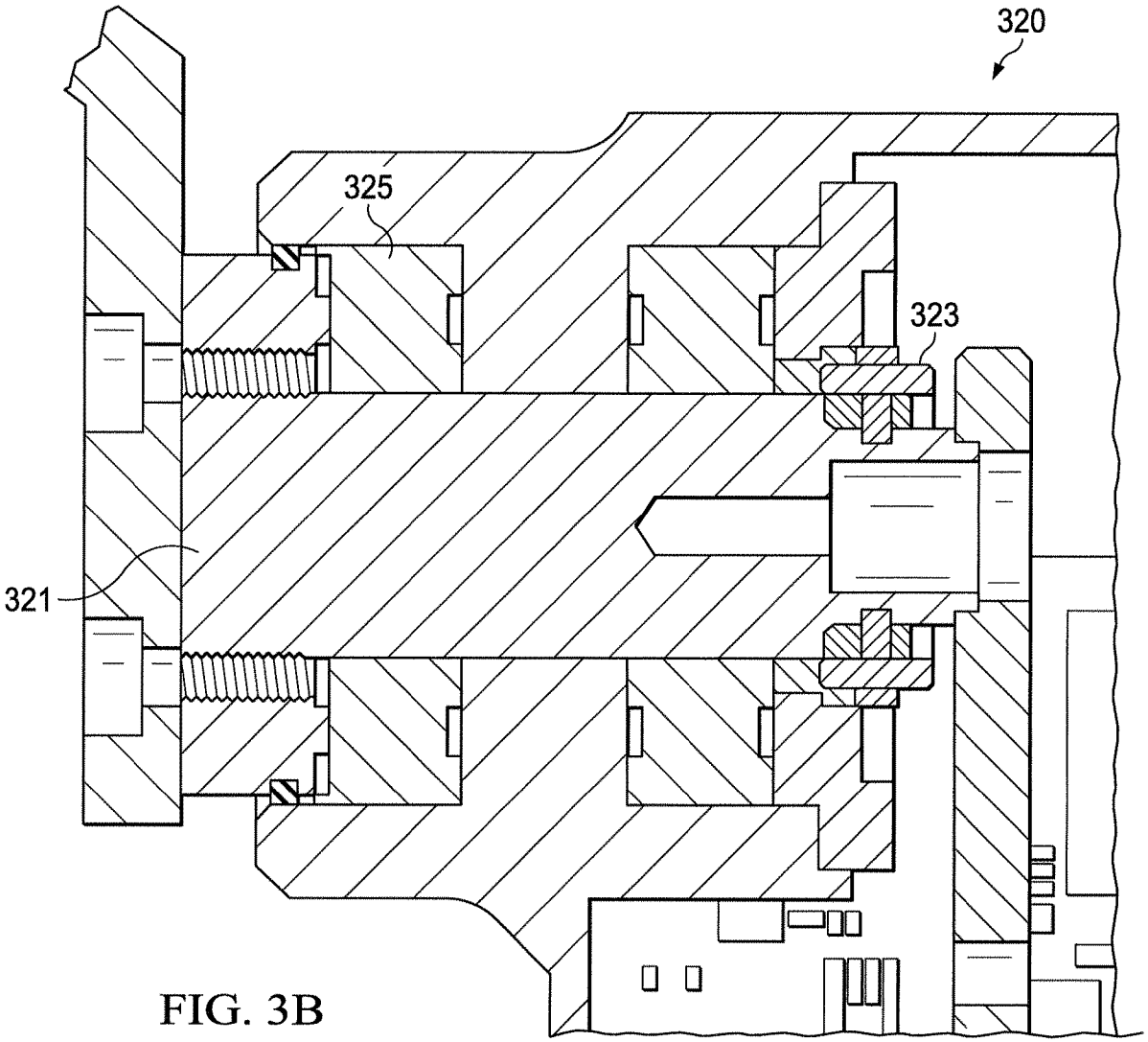

FIGS. 3A and 3B illustrate an example EMSEL system 300 that includes a linear actuator according to this disclosure. Various components of the EMSEL system 300 can represent components included in the EMSEL system 120 or EMSEL system 200 described above. The EMSEL system 300 shown in FIGS. 3A and 3B is for illustration only. Other embodiments of the EMSEL system 300 could be used without departing from the scope of this disclosure.

As shown in FIG. 3A, the EMSEL system 300 includes a linear actuator 320 that serves as a drive assembly for the EMSEL system 300. In some embodiments, the linear actuator 320 is a screw linear actuator with high backdrive force, so no mechanical brake is required to maintain the linear actuator 310 in a static position. The linear actuator 320 can include a primary shaft 321, an angular position sensor 323, and one or more bearings or bushings 325 as shown in FIG. 3B. The primary shaft 321 is connected to a drive linkage 322 that connects an electronics mount 330 to the linear actuator 320. In operation, the primary shaft 321 extends from or retracts into the linear actuator 320, thereby moving the drive linkage 322 and causing the electronics mount 330 to change angle relative to the linear actuator 320. The angular position sensor 323 provides closed-loop angle or rotation sensing, which is used to determine how much to tilt the electronics mount 330. In some embodiments, the angular position sensor 323 may be a resolver or an encoder. In some embodiments, the movement range of the primary shaft 321 may be large enough to provide a corresponding adjustment of the electronics mount 330 through an approximately 40° elevation range of the weapon. Of course, the range of movement of the electronics mount 330 may be more or less, depending on necessity.

Figure 4A:
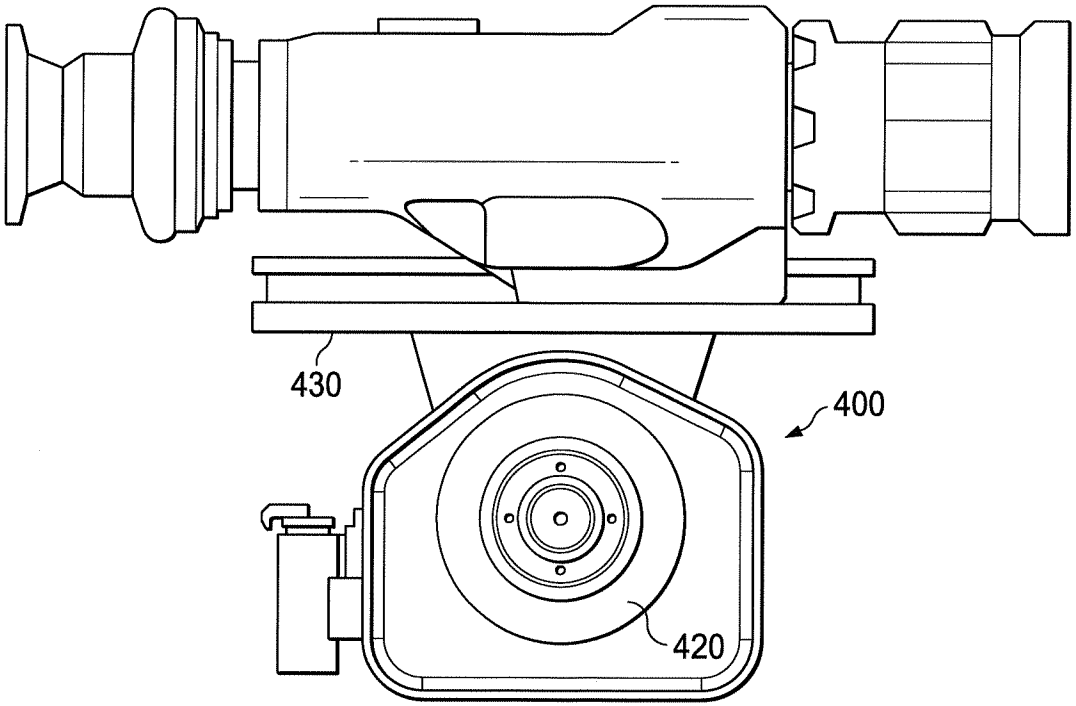
FIGS. 4A and 4B illustrate an example EMSEL system that includes a torque motor according to this disclosure.
Figure 4B:
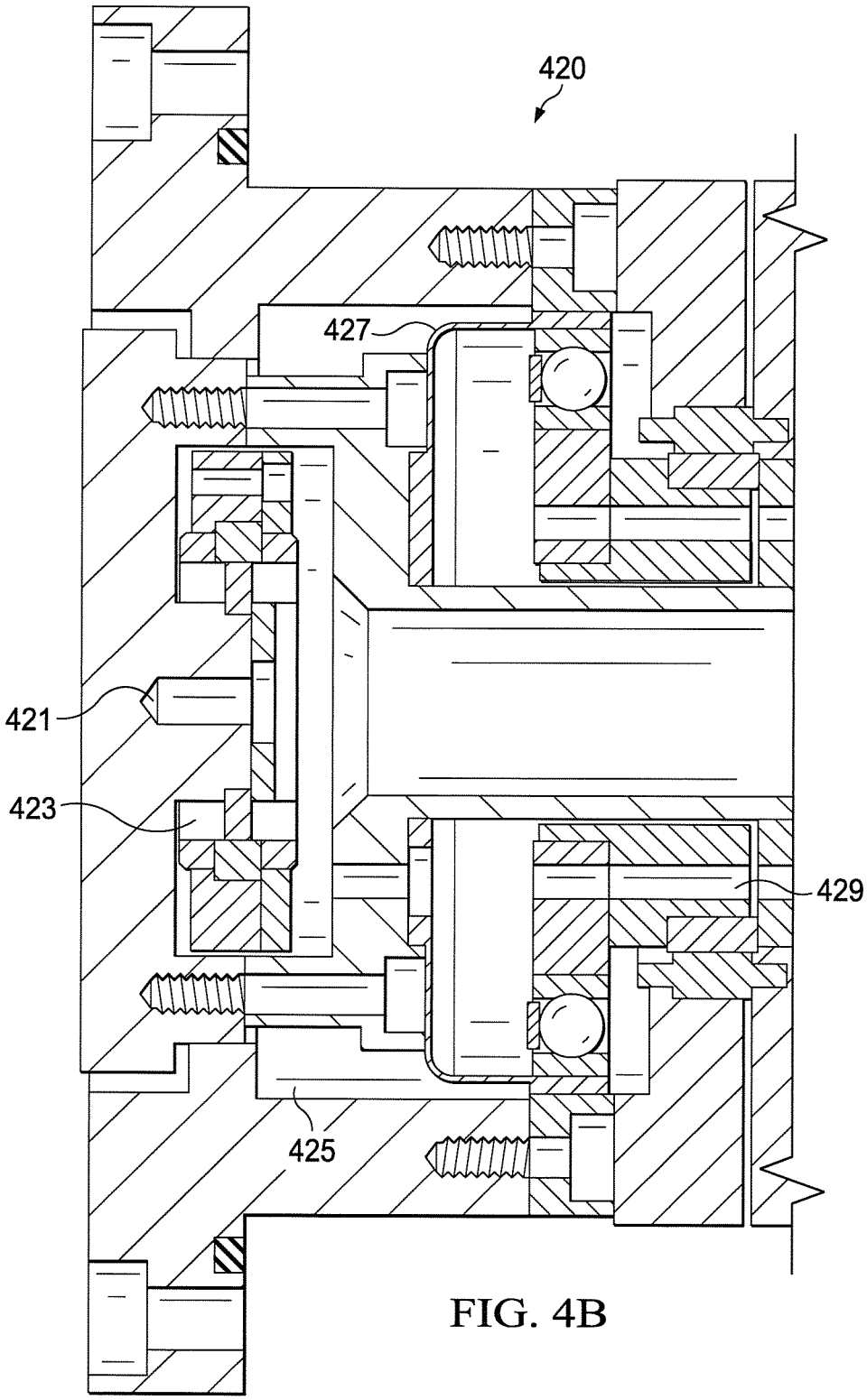

FIGS. 4A and 4B illustrate an example EMSEL system 400 that includes a torque motor according to this disclosure. Various components of the EMSEL system 400 can represent components included in the EMSEL system 120 or EMSEL system 200 described above. The EMSEL system 400 shown in FIGS. 4A and 4B is for illustration only. Other embodiments of the EMSEL system 400 could be used without departing from the scope of this disclosure.

As shown in FIG. 4A, the EMSEL system 400 includes a torque motor 420 that serves as a drive assembly for the EMSEL system 400. The torque motor 420 can include an output shaft 421, an angular position sensor 423, one or more angular contact radial bearings 425, a drive gear 427, and a bi-stable brake 429 as shown in FIG. 4B. In operation, the torque motor 420 rotates the output shaft 421, which is connected to an electronics mount 430. The rotation of the output shaft 421 causes the electronics mount 430 to change angle relative to the torque motor 420. The angular position sensor 423 provides closed-loop angle or rotation sensing, which is used to determine how much to tilt the electronics mount 430. In some embodiments, the angular position sensor 423 may be a resolver or an encoder. The drive gear 427 includes a high reduction gearing component, such as a harmonic drive or planetary gearhead, for high torque movement from a low power input. The torque motor 420 provides a direct drive with zero backlash speed reducing gear. In some embodiments, the torque motor 420 is typically only engaged when super-elevating after ranging, so the torque motor 420 is not powered during weapon fire. The bi-stable brake 429 helps to prevent movement of the electronics mount 430 during weapon shock.

The torque motor 420 may provide a smaller form factor than the linear actuator 320, although the linear actuator 320 may have a lower cost and simpler design with fewer parts.

The torque motor 420 is a low power design that provides improved accuracy during burst fire.

Although FIG. 2 through 4B illustrate particular examples of an EMSEL system, various changes may be made to FIG. 2 through 4B. For example, while the weapon adapter 210 is shown as a flat plate, the weapon adapter 210 could be configured in any other suitable shape or configuration. As another example, one or more of the sensors 240 could be housed within the drive assembly 220. As yet another example, a cam/follower combination could be used independently, or in connection with the EMSEL systems 300, 400 to change the angular position of the electronics mount. As still another example, the linear actuator 310 could be a pneumatic or hydraulic actuator instead of a screw drive. In addition, other components could be added, omitted, combined, or placed in any other configuration according to particular needs.

Figure 5A:
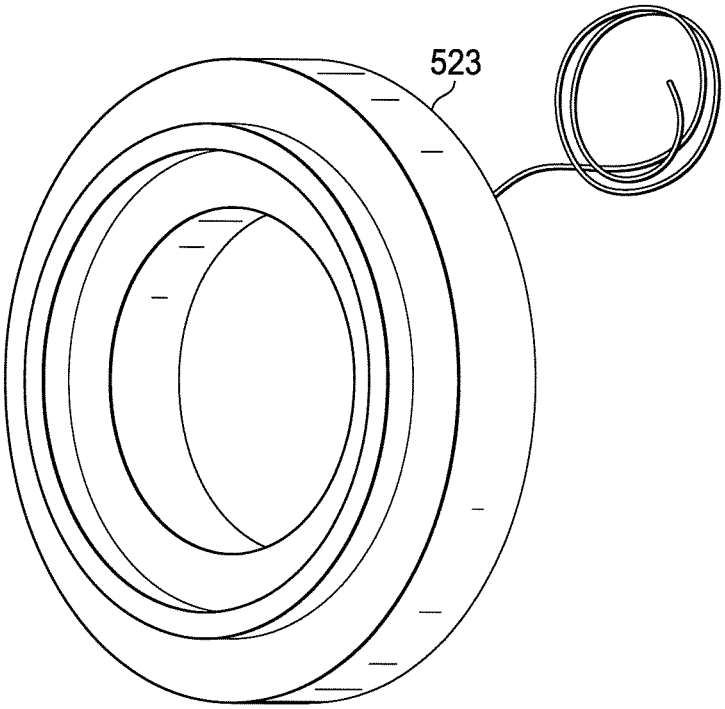
FIGS. 5A through 5C illustrate more detailed views of various example components of an EMSEL system according to this disclosure.
Figure 5B:
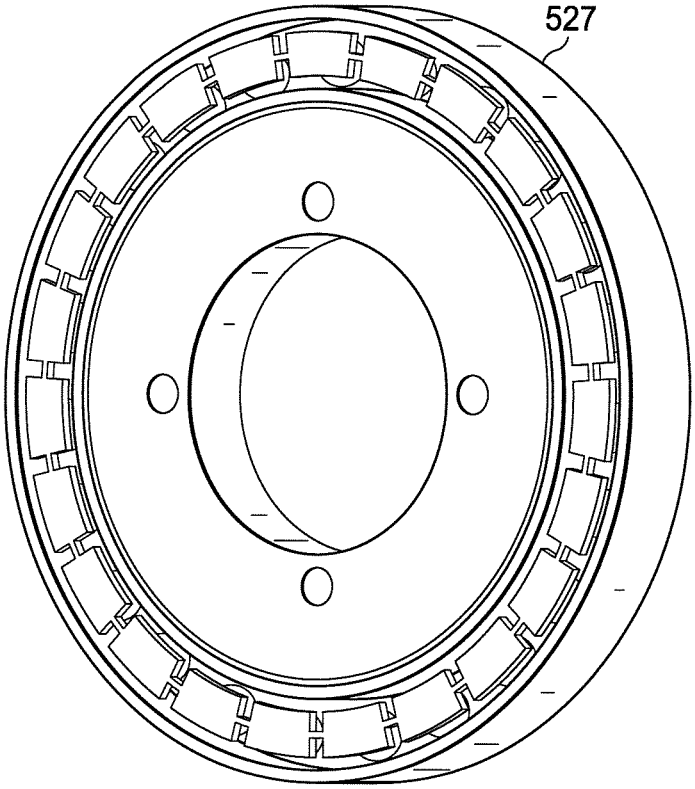
Figure 5C:
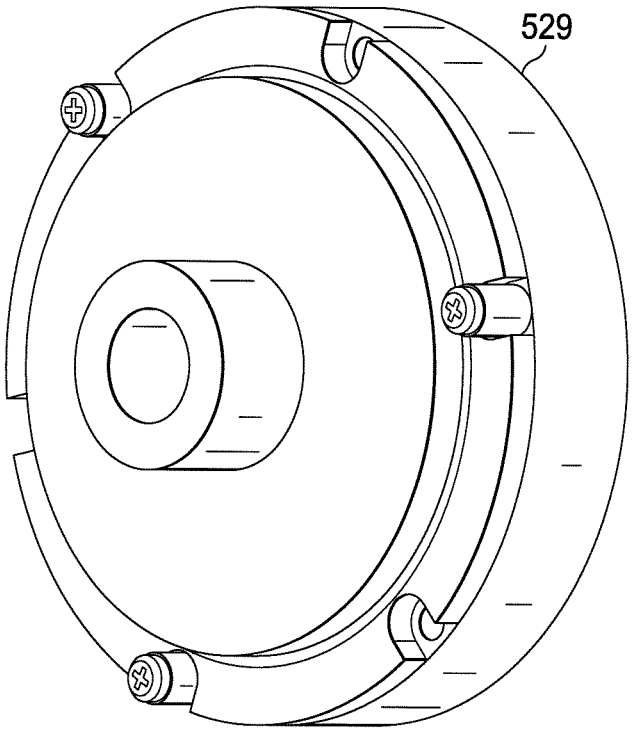

FIGS. 5A through 5C illustrate more detailed views of various example components of an EMSEL system according to this disclosure. These components can represent one or more components shown in FIGS. 1A through 4B. The components shown in FIGS. 5A through 5C are for illustration only. Other embodiments of these components could be used without departing from the scope of this disclosure.

In FIG. 5A, a resolver 523 is an example resolver that can be used for the angular position sensor 323 in FIG. 3B or the angular position sensor 423 in FIG. 4B. As known in the art, a resolver provides accurate position and velocity feedback as well as commutation in precision equipment without many of the structural or temperature restrictions imposed by other electronic feedback devices. A resolver can provide velocity and position information for closed-loop electronic control, as well as brushless DC motor commutation. In general, resolvers contain no internal electronics or optics and are therefore resistant to shock, heat, vibration, and electrical noise levels often encountered in military and aerospace applications. In addition, a resolver is typically economical and highly accurate. For an EMSEL system, the resolver 523 can be configured to read the position of an electronics mount, thereby providing closed-loop positioning of the electronics mount. In some embodiments, the resolver 523 can be a brushless resolver by MOOG, INCORPORATED.

In FIG. 5B, a harmonic drive 527 is an example harmonic drive that can be used for the drive gear 427 of FIG. 4B. As known in the art, a harmonic drive is a low profile, high reduction gearing component. The harmonic drive 527 uses a high speed, low torque input from a low-power lightweight torque motor (such as the torque motor 420) to drive a low speed, high torque output (such as the electronics mount 430). A mechanical advantage provided by the harmonic drive 527 is that it allows for a smaller sized motor to be used in tandem with a small holding brake on the input to get a high increase in torque on the output plate. In some embodiments, this may be an increase of about 160 times. As a particular example, a 45 in-oz motor can provide 37.5 ft-lb driving torque at the electronics mount, and a 1 ft-lb power-off holding brake can provide 160 ft-lb holding torque at the electronics mount.

In FIG. 5C, a holding brake 529 is an example bi-stable rotary brake that can be used for the bi-stable brake 429 of FIG. 4B. The holding brake 529 secures the electronics mount (such as the electronics mount 430) during weapon shock. The holding brake 529 may use power only when switching brake states or when the torque motor is switched on. The power actuates a solenoid that releases the brake for free movement of the torque motor. When power is removed, one or more springs re-engage the brake. The holding brake 529 provides a significant increase in output holding torque when used with a gearing component, such as the harmonic drive 527.

Although FIGS. 5A through 5C illustrate more detailed views of various example components of an EMSEL system, various changes may be made to FIGS. 5A through 5C. For example, the components shown here are examples only, and other components could be used according to particular needs.

Figure 6:
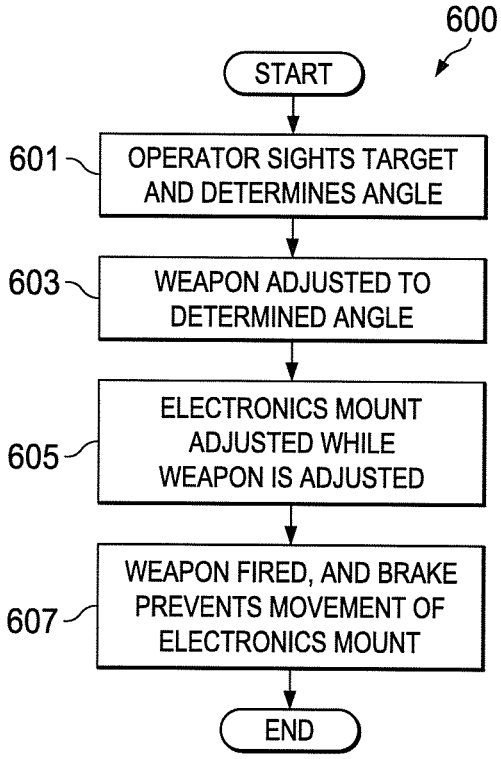
FIG. 6 illustrates an example method for electro-mechanical elevation of a weapon according to this disclosure.

FIG. 6 illustrates an example method 600 for electro-mechanical elevation of a weapon according to this disclosure. The method 600 may be performed using one or more of the components shown in FIGS. 1A through 5, such as the weapon system 100 of FIGS. 1A and 1B. However, the method 600 could be used with any other system.

At step 601, a weapon operator sights a target using a weapon sight, such as the weapon sight 130. At this time, the weapon and the weapon sight may both be pointed toward the target. The operator can use a range finder to determine how far away the target is and to what angle the weapon needs to be elevated.

At step 603, the weapon is adjusted toward the determined angle. As the angle of the weapon is adjusted, electronic control circuitry, such as the controller 250, determines that the weapon is changing in angular orientation. For example, the electronic control circuitry may receive at least one measurement associated with the weapon from one or more sensors, such as an accelerometer.

At step 605, in response to the determination that the weapon is changing in angular orientation, the electronic control circuitry causes an adjustment in an angle of an electronics mount relative to the weapon while the weapon is changing in angular orientation. The adjustment is made such that the electronics mount remains at a predetermined angle relative to the target. The electronics mount acts as a support for the weapon sight. In some embodiments, a linear actuator drive or a torque motor causes the electronics mount to rotate relative to a weapon adapter that is attached to a surface of the weapon. The weapon adapter is coupled to the electronics mount via a drive assembly that includes the linear actuator drive or the torque motor. Also, in some embodiments, a harmonic drive is used to receive a high speed, low torque input from the torque motor and output a low speed, high torque output to the electronics mount. In addition, in some embodiments, while the angle of the electronics mount relative to the weapon is being adjusted, the control circuitry receives feedback of an angular position of the electronics mount from a resolver. The control circuitry then changes a characteristic of the adjustment of the angle (such as a speed of the adjustment or a final angular position) based on the received feedback from the resolver.

At step 607, after movement of the weapon to the final position, the weapon is fired. A brake, such as the bi-stable brake 529, is engaged to prevent angular movement of the electronics mount caused by weapon shock during firing.

Although FIG. 6 illustrates one example of a method 600 for electro-mechanical elevation of a weapon, various changes may be made to FIG. 6. For example, while shown as a series of steps, various steps shown in FIG. 6 could overlap, occur in parallel, occur in a different order, or occur multiple times. Moreover, some steps could be combined or removed and additional steps could be added according to particular needs.

In some embodiments, the EMSEL systems disclosed here employ the use of a linear actuator or small electronic motor in tandem with a high ratio gear to provide angular movement of the electronics mount. Because of the exceptionally high gear ratio, a low power compact motor (driven by fire control algorithms) can output high precision, high torque angular adjustments of the electronics mount to keep the target constantly on sight when super-elevating the weapon. The high precision adjustments help to ensure that accurate ballistic solutions can be calculated, giving an operator "one shot" hit capability. Also, the high torque of the electronics mount in the design helps to ensure that the plate stays substantially stationary looking on target during the rigors of weapon fire without the use of a large clutch mechanism. The disclosed EMSEL systems do not require an operator to take his or her hands off the weapon grips to engage targets, and no manual mechanical adjustment may be needed. This removes costly target acquisition time of returning to "home" position to range and then back to target position to engage. Thus, the time from target identification to target engagement can be significantly reduced, helping to ensure warfighter dominance on the battlefield.

The disclosed EMSEL systems are more robust because the need for optical windows and mirrors has been removed. No fragile glass or optics are required, which can also limit sight adaptability based on ray trace requirements. The disclosed systems do not suffer from double angles caused by light reflecting off mirrors, so it is easier to control jitter.

The disclosed systems feature reduced system costs due to the simplified design. In some embodiments, cost savings are estimated to be approximately 33% to 61% over similar super-elevation systems. In addition, the disclosed embodiments provide a weight reduction, such as up to approximately 17% for a system with one sensor. Larger weight reductions are possible with systems having two or more sensors.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

determining, as a function of one or more measurements from one or more sensors, that a weapon is changing in angular orientation; and in response to the determination that the weapon is changing in angular orientation, adjusting an angle of a rail coupling relative to the weapon by controlling a drive assembly while the weapon is changing in angular orientation such that the rail coupling remains substantially at a predetermined angle relative to a target;

wherein the rail coupling is coupled to a rotation element of the drive assembly and is configured to removably couple an externally-mounted accessory to the weapon; and wherein the drive assembly is coupled to the weapon through a weapon adapter coupled to the weapon and is configured to rotate the rotation element relative to a remainder of the drive assembly.

2. The method of claim 1, wherein:

adjusting the angle of the rail coupling comprises operating a linear actuator drive or a torque motor to cause the rail coupling to automatically rotate relative to the weapon adapter in order to maintain the rail coupling in a stable, substantially static position as the weapon moves;

the weapon adapter is attached to a surface of the weapon, the weapon adapter coupled to an electronics mount via the drive assembly that includes the linear actuator drive or the torque motor; and the rail coupling is disposed on the electronics mount.

3. The method of claim 2, wherein adjusting the angle of the rail coupling comprises operating the torque motor by:

receiving, at a harmonic drive coupled to the torque motor and the electronics mount, a high speed, low torque input from the torque motor; and outputting, at the harmonic drive, a low speed, high torque output to the electronics mount.

4. The method of claim 1, wherein adjusting the angle of the rail coupling comprises:

receiving feedback of an angular position of the rail coupling while the angle of the rail coupling relative to the weapon is adjusted; and changing a characteristic of the adjusting of the angle based on the received feedback.

5. The method of claim 1, wherein the one or more sensors comprise one or more position or angle sensors configured to measure a position, orientation, or angle of one or more of: the rail coupling, an electronics mount, the weapon adapter, the rotation element, or another component relative to horizontal, to the weapon, or to each other.

6. The method of claim 1, further comprising:

after movement of the rail coupling, operating a holding brake to substantially prevent angular movement of the rail coupling caused by weapon shock during firing of the weapon.

7. The method of claim 1, wherein the weapon is a low-velocity round weapon.

8. An apparatus comprising:

a weapon adapter comprising a substantially flat plate configured to vertically mount to a side wall of a weapon;

an electronics mount including a rail coupling configured to removably couple an externally-mounted weapon sight to the electronics mount, the externally-mounted weapon sight configured to sight a target;

a drive assembly coupled between the weapon adapter and the electronics mount;

one or more sensors configured to measure a position, orientation, or angle; and a controller including processing circuitry, the controller configured to:

determine, as a function of one or more measurements from the one or more sensors, that the weapon is changing in angular orientation; and in response to a determination that the weapon is changing in angular orientation, control the drive assembly to adjust an angle of the rail coupling relative to the weapon while the weapon is changing in angular orientation such that the rail coupling remains substantially at a predetermined angle relative to the target;

wherein the apparatus lacks an optical instrument prior to coupling of the externally-mounted weapon sight to the electronics mount via the rail coupling.

9. The apparatus of claim 8, wherein:

the drive assembly comprises a linear actuator drive or a torque motor; and the controller is configured to control operation of the linear actuator drive or the torque motor to cause the rail coupling to automatically rotate relative to the weapon adapter in order to maintain the rail coupling in a stable, substantially static position as the weapon moves.

10. The apparatus of claim 9, further comprising:

a harmonic drive coupled to the torque motor and the electronics mount, the harmonic drive configured to:

receive a high speed, low torque input from the torque motor; and output a low speed, high torque output to the electronics mount.

11. The apparatus of claim 8, wherein, to control the drive assembly, the controller is configured to:

receive feedback of an angular position of the rail coupling while the angle of the rail coupling relative to the weapon is adjusted; and change a characteristic of the adjusting of the angle based on the received feedback.

12. The apparatus of claim 8, wherein the one or more sensors comprise an accelerometer or inertial measurement unit configured to measure the position, orientation, or angle of one or more of: the rail coupling, the electronics mount, the weapon adapter, a rotation element, or another component relative to horizontal, to the weapon, or to each other.

13. The apparatus of claim 8, wherein the controller is further configured, after movement of the rail coupling, to operate a holding brake to substantially prevent angular movement of the rail coupling caused by weapon shock during firing of the weapon.

14. The apparatus of claim 8, wherein the substantially flat plate comprises at least one of: one or more rails and one or more dovetail connectors configured to couple to corresponding rails or connection elements in the side wall of the weapon.

15. A weapon system comprising:

a weapon;

an external weapon sight configured to sight a target of the weapon, the external weapon sight comprising a housing and sighting components; and an electro-mechanical super-elevation (EMSEL) system configured to removably couple the external weapon sight to the weapon, the EMSEL system comprising:

a weapon adapter coupled to the weapon;

an electronics mount removably coupled to the housing of the external weapon sight via a rail coupling;

a drive assembly coupled to the weapon adapter and the electronics mount;

one or more sensors configured to measure a position, orientation, or angle; and a controller configured to:

determine, as a function of one or more measurements from the one or more sensors, that the weapon is changing in angular orientation; and in response to a determination that the weapon is changing in angular orientation, control the drive assembly to adjust an angle of the rail coupling relative to the weapon while the weapon is changing in angular orientation such that the rail coupling remains substantially at a predetermined angle relative to the target.

16. The weapon system of claim 15, wherein:

the drive assembly comprises a linear actuator drive or a torque motor; and the controller is configured to control operation of the linear actuator drive or the torque motor to cause the rail coupling to automatically rotate relative to the weapon adapter in order to maintain the rail coupling in a stable, substantially static position as the weapon moves.

17. The weapon system of claim 16, further comprising:

a harmonic drive coupled to the torque motor and the electronics mount, the harmonic drive configured to:

receive a high speed, low torque input from the torque motor; and output a low speed, high torque output to the electronics mount.

18. The weapon system of claim 15, wherein, to control the drive assembly to adjust the angle of the rail coupling relative to the weapon, the controller is configured to:

receive feedback of an angular position of the rail coupling while the angle of the rail coupling relative to the weapon is adjusted; and change a characteristic of the adjusting of the angle based on the received feedback.

19. The weapon system of claim 15, wherein the one or more sensors comprise an accelerometer or inertial measurement unit configured to measure the position, orientation, or angle of one or more of: the rail coupling, the electronics mount, the weapon adapter, a rotation element, or another component relative to horizontal, to the weapon, or to each other.

20. The weapon system of claim 15, wherein the controller is further configured, after movement of the rail coupling, to operate a holding brake to substantially prevent angular movement of the rail coupling caused by weapon shock during firing of the weapon.

21. The weapon system of claim 15, wherein the weapon is a low-velocity round weapon.

* * * * *